US007740312B2

(12) United States Patent
Johnson, Jr.

(10) Patent No.: US 7,740,312 B2
(45) Date of Patent: Jun. 22, 2010

(54) PORTABLE DRINK HOLDER WITH INTERNAL READER LIGHT

(75) Inventor: Theodore C. Johnson, Jr., Solon, OH (US)

(73) Assignee: Erie Works Corp., Frisco, CO (US)

( * ) Notice: Subject to any disclaimer, the term of this patent is extended or adjusted under 35 U.S.C. 154(b) by 719 days.

(21) Appl. No.: 11/605,024

(22) Filed: Nov. 28, 2006

(65) Prior Publication Data

US 2008/0121774 A1 May 29, 2008

(51) Int. Cl.
*A47C 7/72* (2006.01)

(52) U.S. Cl. ..... 297/217.6; 297/163; 248/311.2; 108/44

(58) Field of Classification Search ..... 297/163, 297/188.06, 188.2, 188.21; 248/311.2; 108/42, 108/44
See application file for complete search history.

(56) References Cited

U.S. PATENT DOCUMENTS 5,386,958 A * 2/1995 Amato ..... 248/311.2 X
5,813,354 A * 9/1998 Scott ..... 108/44
5,931,102 A * 8/1999 Grahl ..... 108/42 X
6,279,992 B1 * 8/2001 Plocher et al. ..... 297/163 X
6,607,241 B2 * 8/2003 Johnston ..... 297/188.06 X
6,941,601 B2 * 9/2005 DeBartolo et al. ..... 5/639
6,994,401 B1 * 2/2006 Fischer et al. ..... 297/163 X

* cited by examiner

*Primary Examiner*—Anthony D Barfield
(74) *Attorney, Agent, or Firm*—Sand & Sebolt

(57) ABSTRACT

A drink holder assembly includes a drink holder which is mountable above a tray, such as an airline table tray mounted on the back of an airline chair. Typically, a support extends downwardly from the drink holder and a mounting mechanism connected to the support removably mounts the drink holder on the tray. A reading light is preferably mounted on the drink holder to provide light directed toward the tray. The assembly may include another light so that the assembly serves as a flashlight useful for emergency purposes. The assembly is collapsible to fit within a purse or briefcase. The drink holder may be spaced sufficiently above the tray to accommodate a laptop computer seated on the tray.

26 Claims, 10 Drawing Sheets

PORTABLE DRINK HOLDER WITH INTERNAL READER LIGHT

BACKGROUND OF THE INVENTION

1. Technical Field

This invention relates generally to a portable drink holder. More particularly, the invention relates generally to a collapsible and portable drink holder which is mountable on an airline tray table or the like. Specifically, the invention relates to such a drink holder having an internal reading light and/or emergency light.

2. Background Information

As is well known, commercial airlines utilize tray tables which are mounted on the rear of the seats within aircraft. Similarly, some trains, buses and other vehicles use such tray tables. Among various configurations are tray tables which may be stowed in recesses in the rear of the seat or may fit within arm rests. Some tray tables are removable while others are permanently attached to the seat. The primary purpose of such tray tables is to provide a stowable table on which passengers (airline or otherwise) place food and drink. Obviously, these tray tables are also used to support various other items such as books, magazines, laptop computers and so forth. These tray tables are relatively small and thus can accommodate only a relatively small number of items thereon. This limited amount of space makes it difficult for the passenger to use the tray table to support the reading material or the like along with drink containers. Thus, there is a need in the art for a drink holder for supporting drink containers separate from the tray table so that the tray table may be used for other purposes without interference from drink containers seated thereon. The present invention solves this and other problems in the art.

BRIEF SUMMARY OF THE INVENTION

The present invention provides an apparatus comprising a drink holder adapted for supporting a drink container; a support extending downwardly from the drink holder; and a tray mount connected to the support, spaced downwardly from the drink holder and adapted to mount the drink holder on a tray.

The present invention also provides an apparatus comprising a chair having a seat and a back extending upwardly therefrom; a table tray mounted on the chair back and extending rearwardly therefrom; and a drink holder which is mounted on one of the table tray and chair back, spaced upwardly from the table tray and adapted for supporting a drink container.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
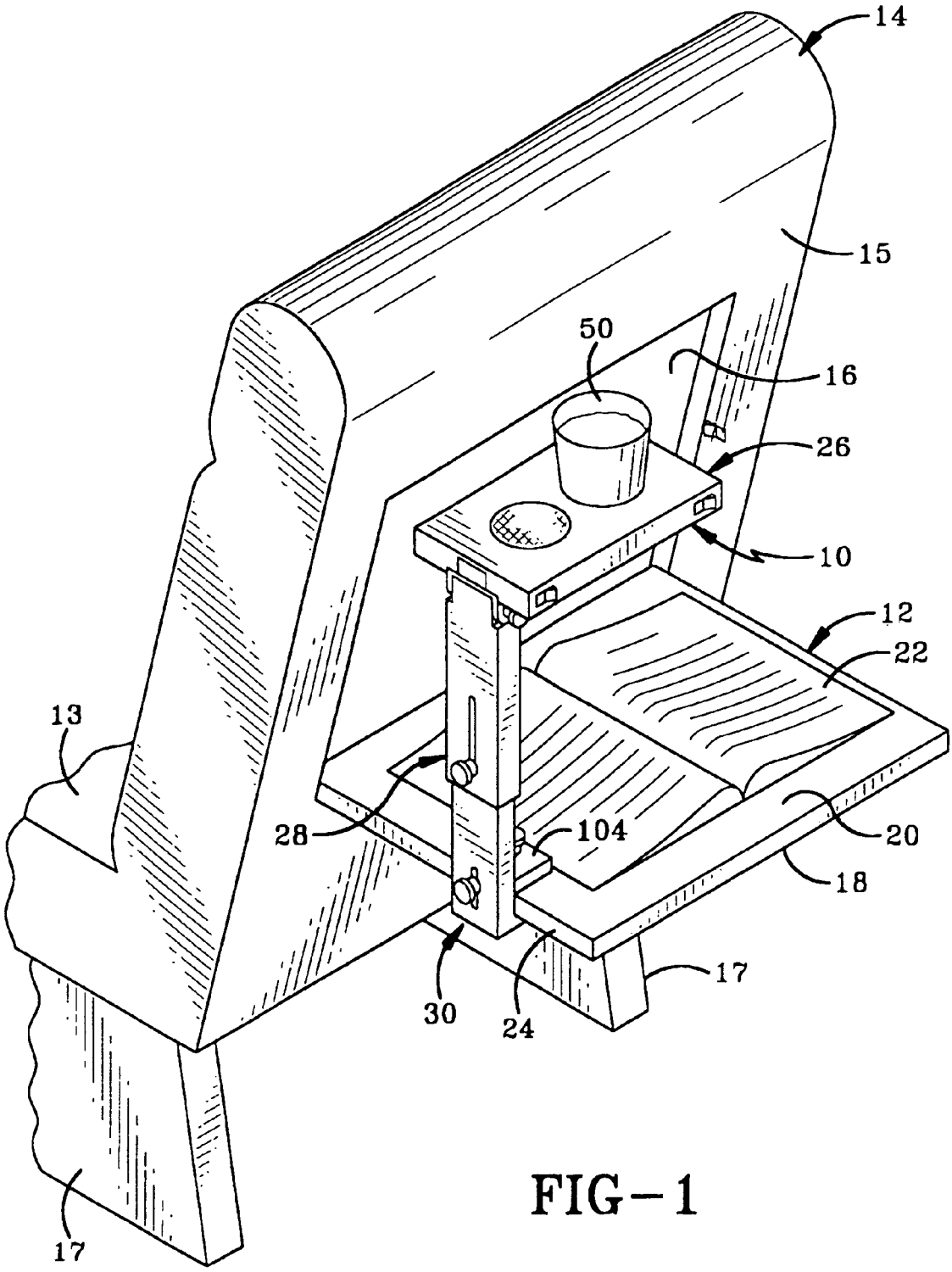
FIG. 1 is a perspective view of the drink holder assembly of the present invention mounted on an airline tray table.
Figure 2:
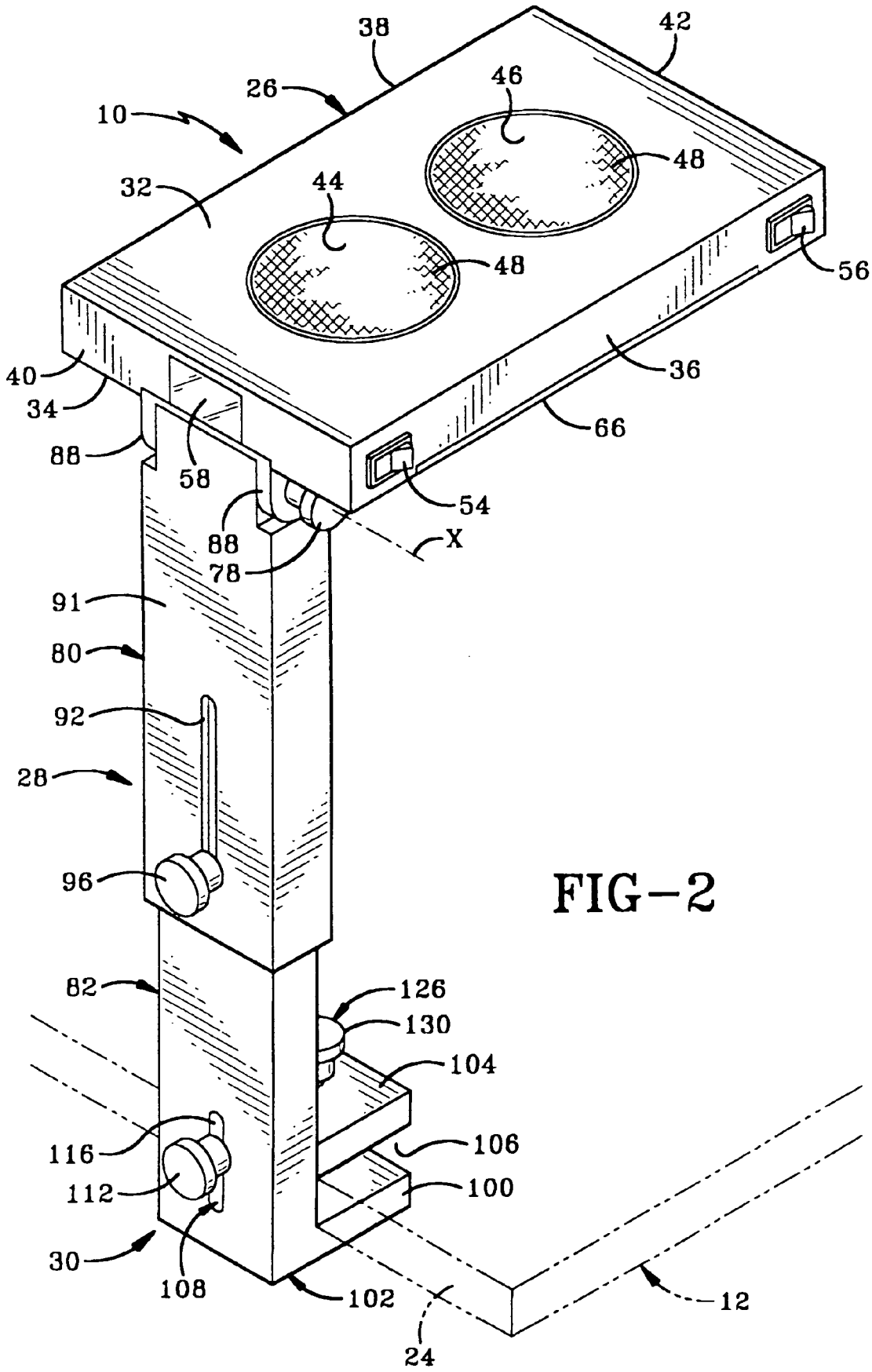
FIG. 2 is an enlarged perspective view of the drink holder assembly.

The drink holder assembly of the present invention is shown generally at 10 in FIGS. 1 and 2. Assembly 10 is shown in FIG. 1 mounted on a substantially flat airline or other table tray 12 which is moveably mounted on an airline or other chair 14 comprising a seat 13, a back 15 extending upwardly therefrom and legs 17 extending downwardly from seat 13. More particularly, tray 12 is mounted on back 15 and movable between an open position which is shown in FIG. 1 and a stowed position in which table tray 12 fits within a recessed area 16 formed in back 15. Table tray 12 has a lower surface 18 and an upper surface 20 on which reading material in the form of a book or magazine is seated. Table tray 12 includes an edge 24 adjacent which drink holder assembly 10 is mounted on tray 12.

Figure 12:
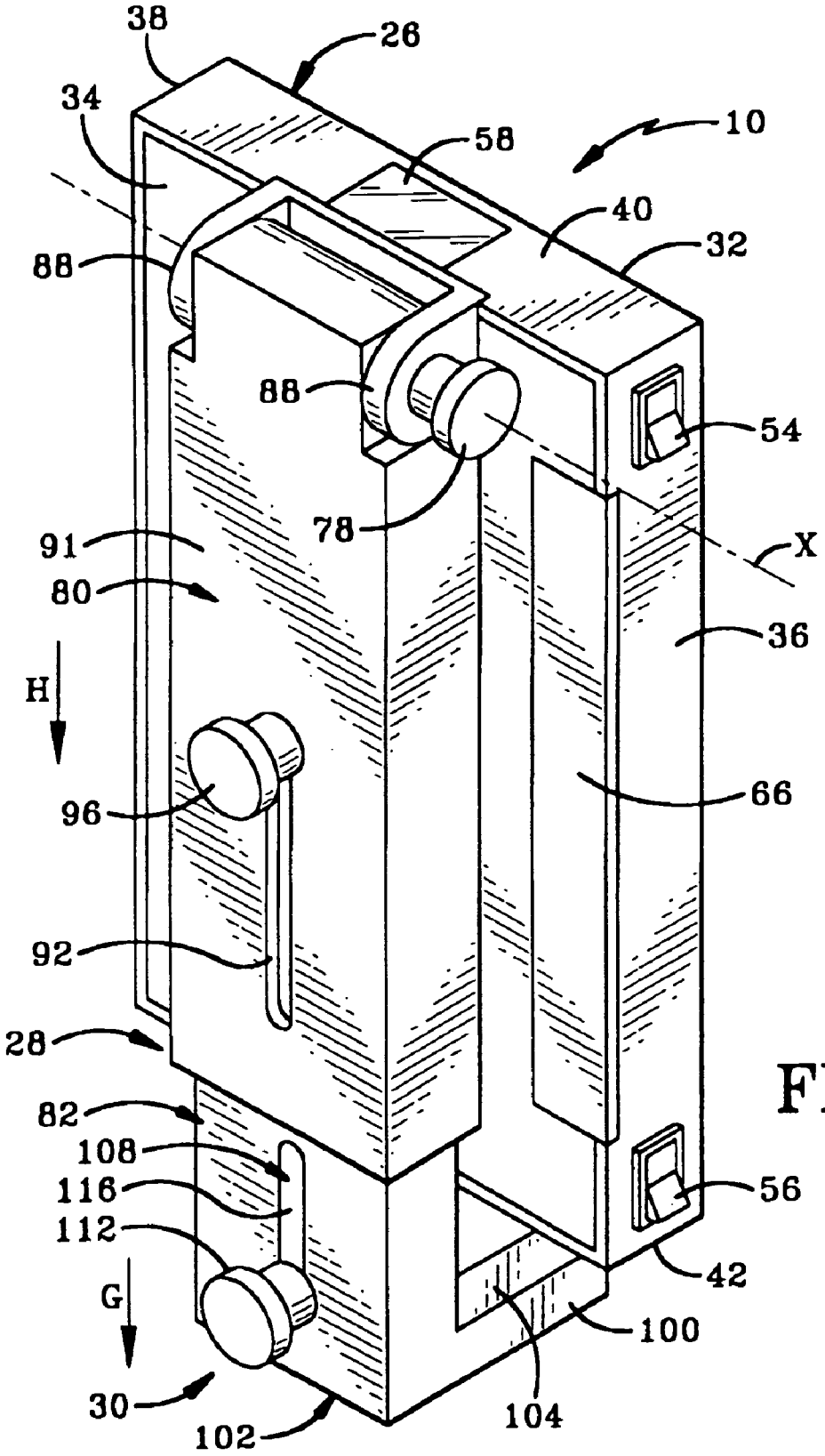
FIG. 12 is a perspective view showing the drink holder assembly in the fully collapsed position.

Referring to FIGS. 1 and 2, assembly 10 includes a substantially flat rectangular drink holder 26 and a support 28 having a mounting mechanism in the form of a clamping mechanism 30 for removably mounting assembly 10 on table tray 12 adjacent edge 24 thereof. Assembly 10 is moveable between an erected operational position shown in FIGS. 1 and 2 and a collapsed position shown in FIGS. 12 and 13. In the erected position, drink holder 26 is disposed behind back 15 and sufficiently upwardly of upper surface 20 of table tray 12 to accommodate various objects such as magazine 22 or a laptop computer (not shown) with the lid opened in an upright position. Assembly 10 is further configured to provide a reading light 64 (FIG. 5) which projects downwardly toward table tray 12 as will be discussed further below. In the collapsed position, assembly 10 is configured to fit within a briefcase or a lady's purse.

Figure 9:
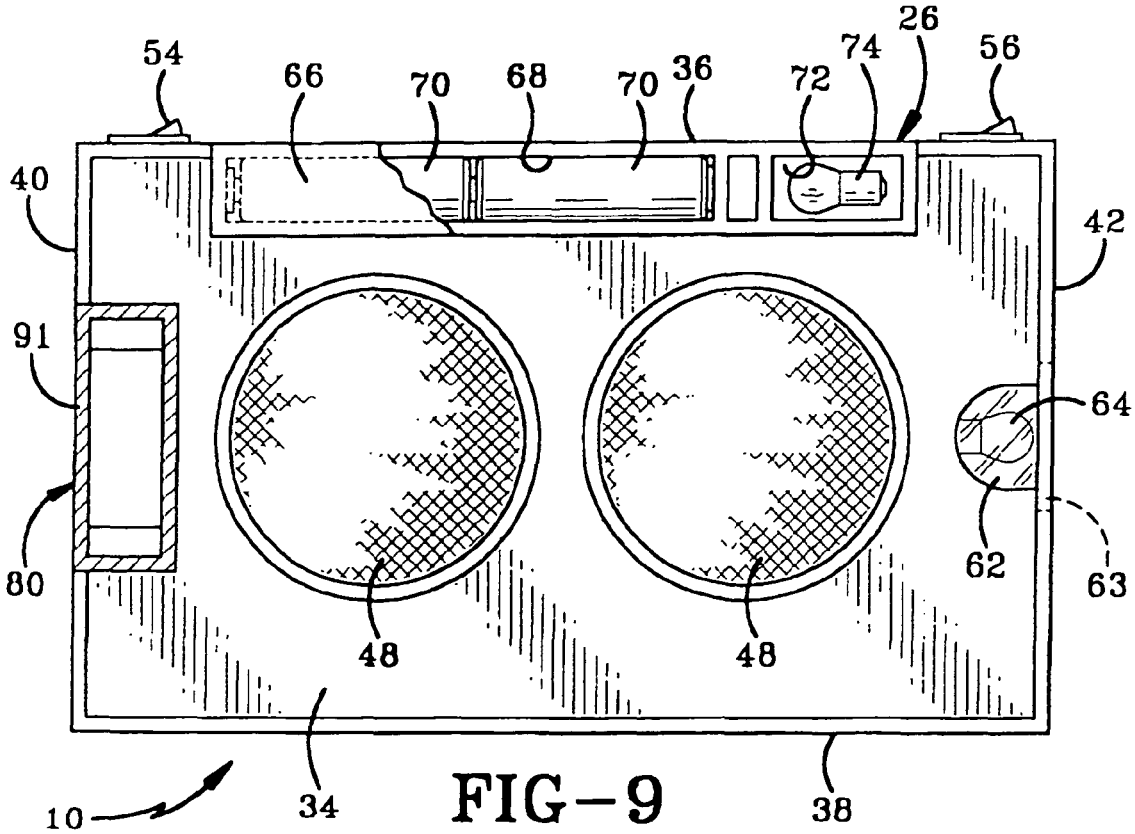
FIG. 9 is a sectional view taken on line 9-9 of FIG. 5 with portions cut away to shown the battery compartment and spare light bulb.

Referring to FIG. 2, drink holder 26 has a top 32, a bottom 34, a front 36, a back 38 and first and second sides 40 and 42. Holder 26 defines first and second cylindrical receptacles 44 and 46 are preferably through holes which extend downwardly from top 32 to bottom 34 although they may be bounded by respective bottom walls if desired. Flexible pockets or bag-shaped absorbent pads 48 are connected to holder 26 and hang respectively below receptacles 44 and 46 in the operational position and are configured to absorb water or other liquids such as water condensing on cold drink containers seated within the receptacles. Such drink containers may include a glass or cup such as cup 50 (FIG. 1) or other beverage container such as a can 52 (FIG. 5), bottle or the like. Manually accessible first and second electrical switches 54 and 56 are mounted on holder 26 adjacent front 36. A transparent flashlight lens 58 is mounted on holder 26 and forms a portion of first side 40 thereof. A flashlight bulb 60 (FIG. 3) is disposed within an interior chamber of holder 26 adjacent lens 58 and is operated by on/off switch 54. Lens 58 also serves as an access cover to provide access to bulb 60. In addition, a reading light lens 62 (FIGS. 4-5) is mounted on holder 26 and forms a portion of bottom 34 thereof. Reading light bulb 64 (FIGS. 4-5) is disposed within an interior chamber of holder 26 above and adjacent lens 62 and is operated by on/off switch 56. An access cover 63 (FIG. 4) is mounted on holder 26 adjacent bulb 64 and forms a portion of side 42 of holder 26. An access cover 66 is mounted on holder 26 and is either or openable and closable or removable and replaceable to selectively cover and provide access to a battery compartment 68 which houses batteries 70 and a spare bulb compartment 72 which houses a spare light bulb 74 (FIG. 9).

Figure 3:
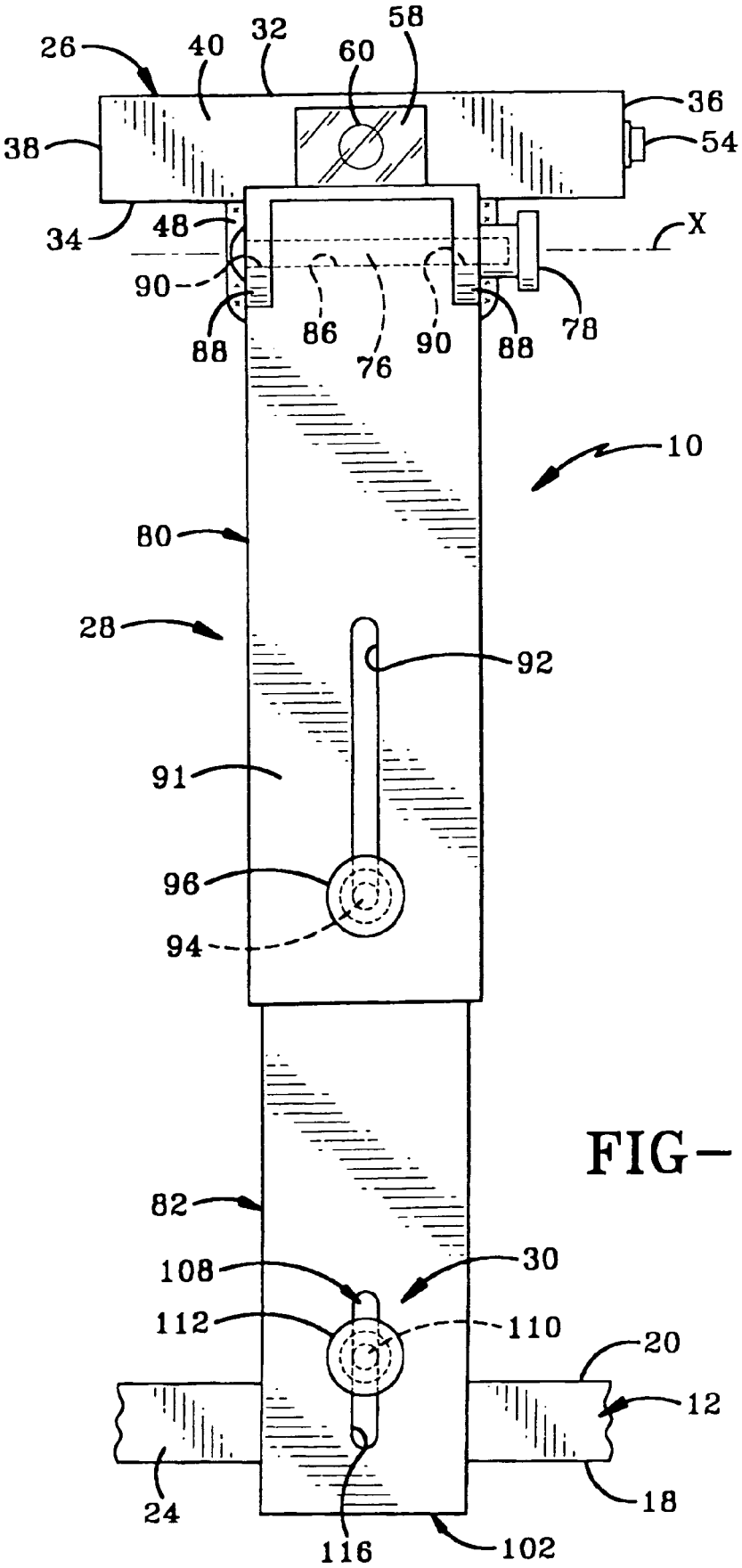
FIG. 3 is a side elevational view of the drink holder assembly taken from one side thereof.
Figure 4:
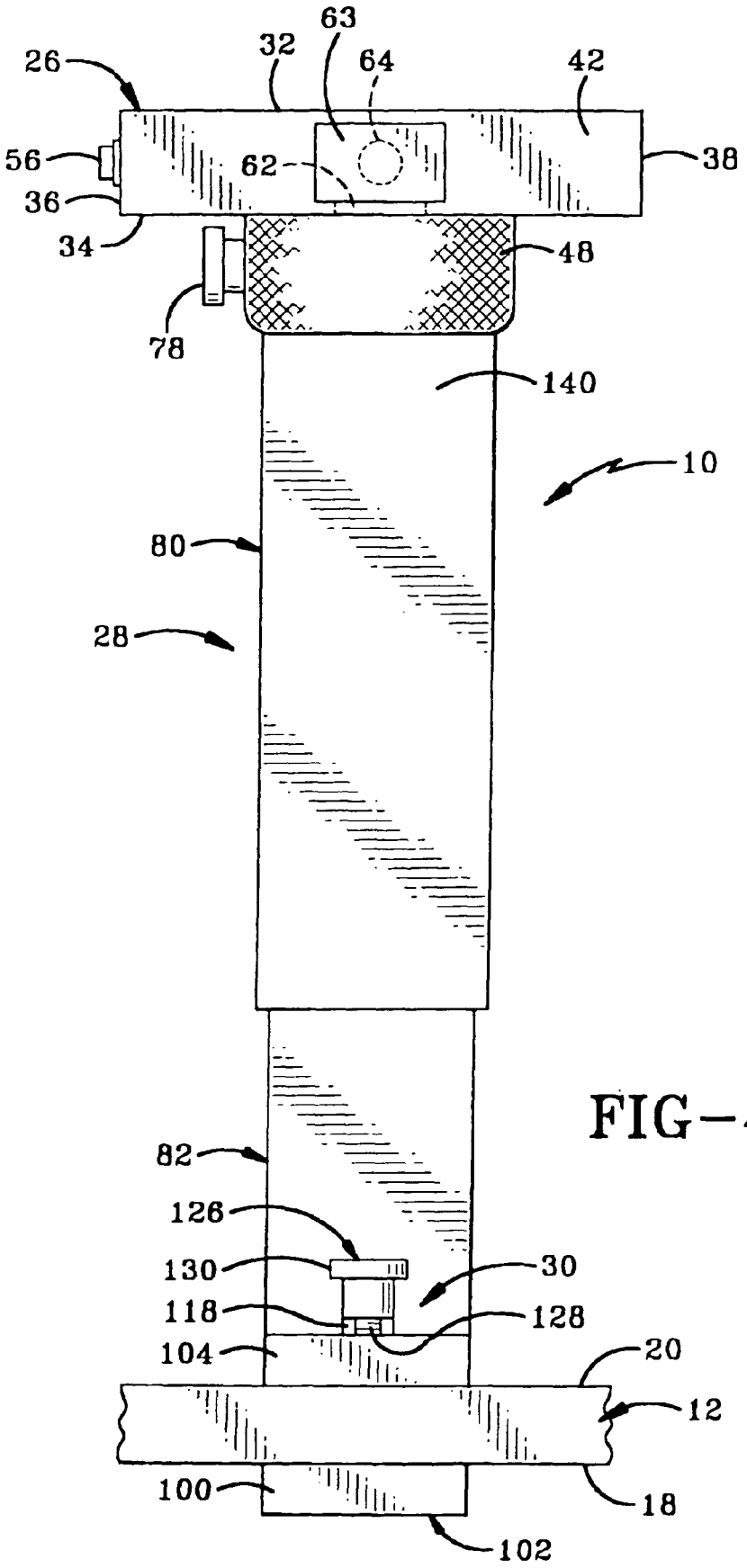
FIG. 4 is a side elevational view of the drink holder assembly taken from the other side thereof.

Referring to FIGS. 2-5, holder 26 is pivotally mounted about an axis X via a pivot 76 (FIG. 3). A securing mechanism is provided to secure holder 26 in the erected position and in the collapsed position. The securing mechanism is manually operable and includes a knob or handle 78 providing a finger grip to that effect. Handle 78 may be in the form of a nut which is threadably engaged with pivot 76 or may include another quick release mechanism which includes detents for retaining holder 26 respectively in the erected position and the collapsed position. Similarly, the small handle utilizing an over center cam may provide a tightening mechanism to retain holder 26 in the erected or collapsed positions. Other securing mechanisms known in the art may be used. Support 28 is in the form of a telescoping arm having a first or upper arm segment 80 and a second or lower arm segment 82 which is slidably received within an interior chamber 84 (FIG. 5) of hollow segment 80 in a telescoping fashion. Arm segment 80 defines a through bore 86 adjacent its upper end which receives therein pivot 76. A pair of spaced mounting flanges 88 extend downwardly from holder 26 and define respective through holes 90 which are aligned with bore 86 and likewise receive pivot 76 therein. A sidewall 91 of arm segment 80 defines a slot 92 which is elongated vertically when assembly 10 is in the mounted position. Slot 92 receives therein a threaded rod 94 of a threaded member having a handle 96 which provides a finger grip for manual operation. Threaded rod 94 is threadedly received within a threaded hole 98 formed in second arm segment 82 so that handle 96 may be rotated to alternately secure arm segments 80 and 82 together or release them to allow for relative sliding movement therebetween with rod 94 sliding within slot 92.

Figure 7:
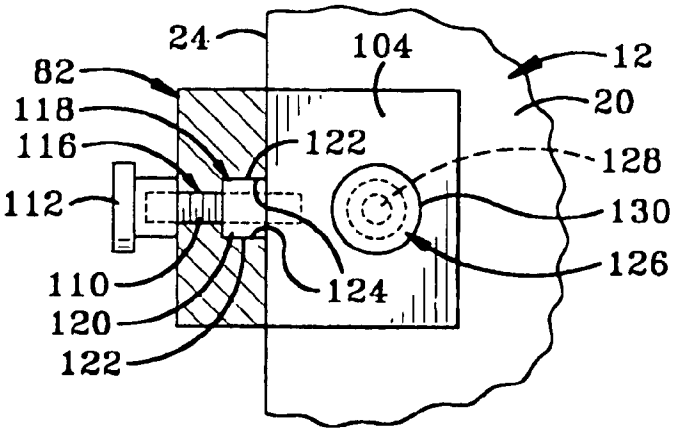
FIG. 7 is a sectional view taken on line 7-7 of FIG. 6.

With continued reference to FIGS. 2-5, clamping mechanism 30 includes a first leg 100 is rigidly connected to and extends outwardly perpendicularly from second arm segment 82 adjacent a lower end 102 thereof. A second leg 104 is moveably connected to second arm segment 82 and is disposed above first leg 100. Second leg 104 is slidably mounted on arm segment 82 and moveable away from first leg 100 to define a space 106 therebetween for receiving a portion of table tray 12 therein. Arm segment 82 defines a slot 108 adjacent lower end 102 which is elongated vertically when assembly 10 is in the mounted position. Slot 108 receives therein a threaded rod 110 (FIG. 5) of a threaded member having a handle 112 providing a finger grip which makes the threaded member manually operable. Threaded rod 110 is threadedly received within a threaded hole 114 formed in second leg 104. Handle 112 is manually rotatable to alternately secure leg 104 in a fixed position relative to arm segment 82 and release leg 104 to allow it to slide up and down relative to arm segment 82 as indicated at arrow A in FIG. 5. Slot 108 includes a narrower portion 116 and a wider elongated counter bore portion 118 (FIG. 5) which receives therein a tongue 120 which extends outwardly from leg 104 and serves as a guide which prevents leg 104 from rotating relative to arm segment 82. More particularly, tongue 120 has a noncircular configuration and preferably includes opposed flats 122 (FIG. 7) which engage flat surfaces 124 which bound portion 118 of slot 108. A clamping screw 126 includes a threaded rod 128 and a handle 130 providing a finger grip for manually operating screw 126. Threaded rod 128 threadedly engages a threaded hole 132 formed in second leg 134. A clamping plate or disk 134 is rotatably mounted on rod 132 and configured to clampingly engage upper surface 20 of tray table 12.

Figure 10:
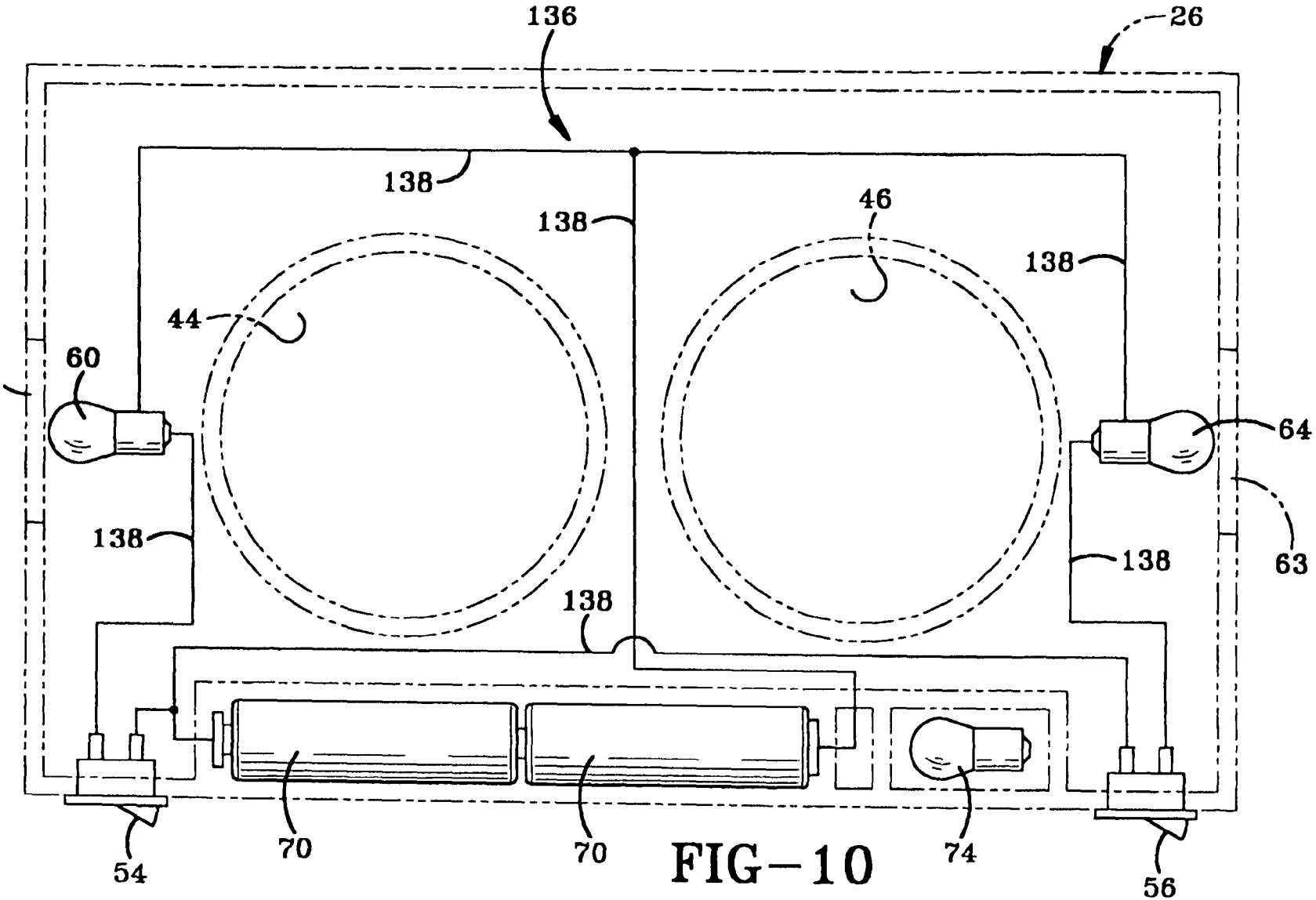
FIG. 10 is a diagrammatic view of the electrical circuitry of the drink holder assembly with the drink holder shown in dot dash lines.
Figure 11:
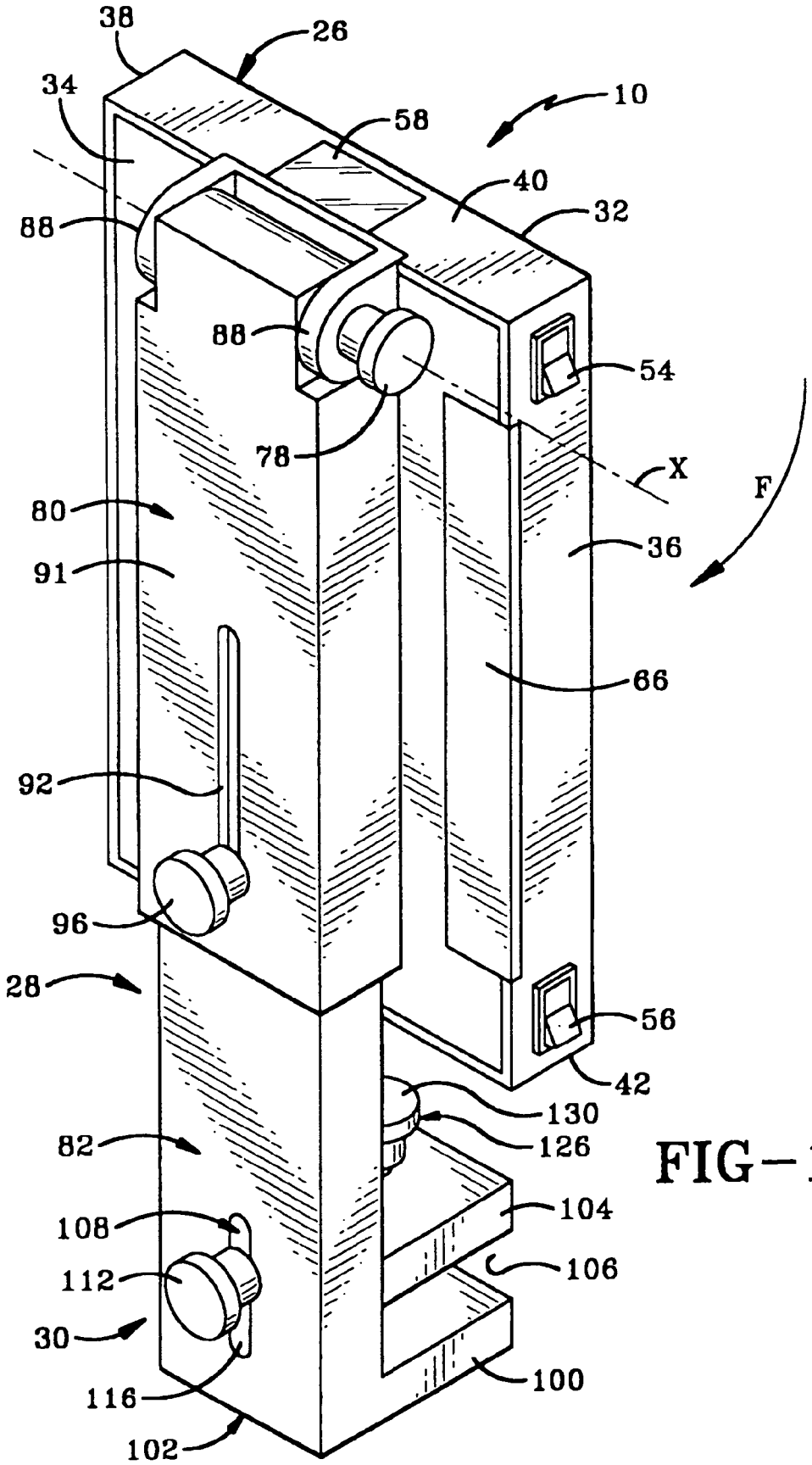
FIG. 11 is a perspective view showing the drink holder assembly in a partially collapsed position.

FIG. 10 shows electrical circuitry 136 for operating light bulbs 60 and 64 respectively via switches 54 and 56. More particularly, circuitry 136 includes a plurality of electrical conductors 138 which provide electrical communication between batteries 70, switches 54 and 56 and bulbs 60 and 64 so that bulbs 60 and 64 are independently operable via switches 54 and 56.

Figure 5:
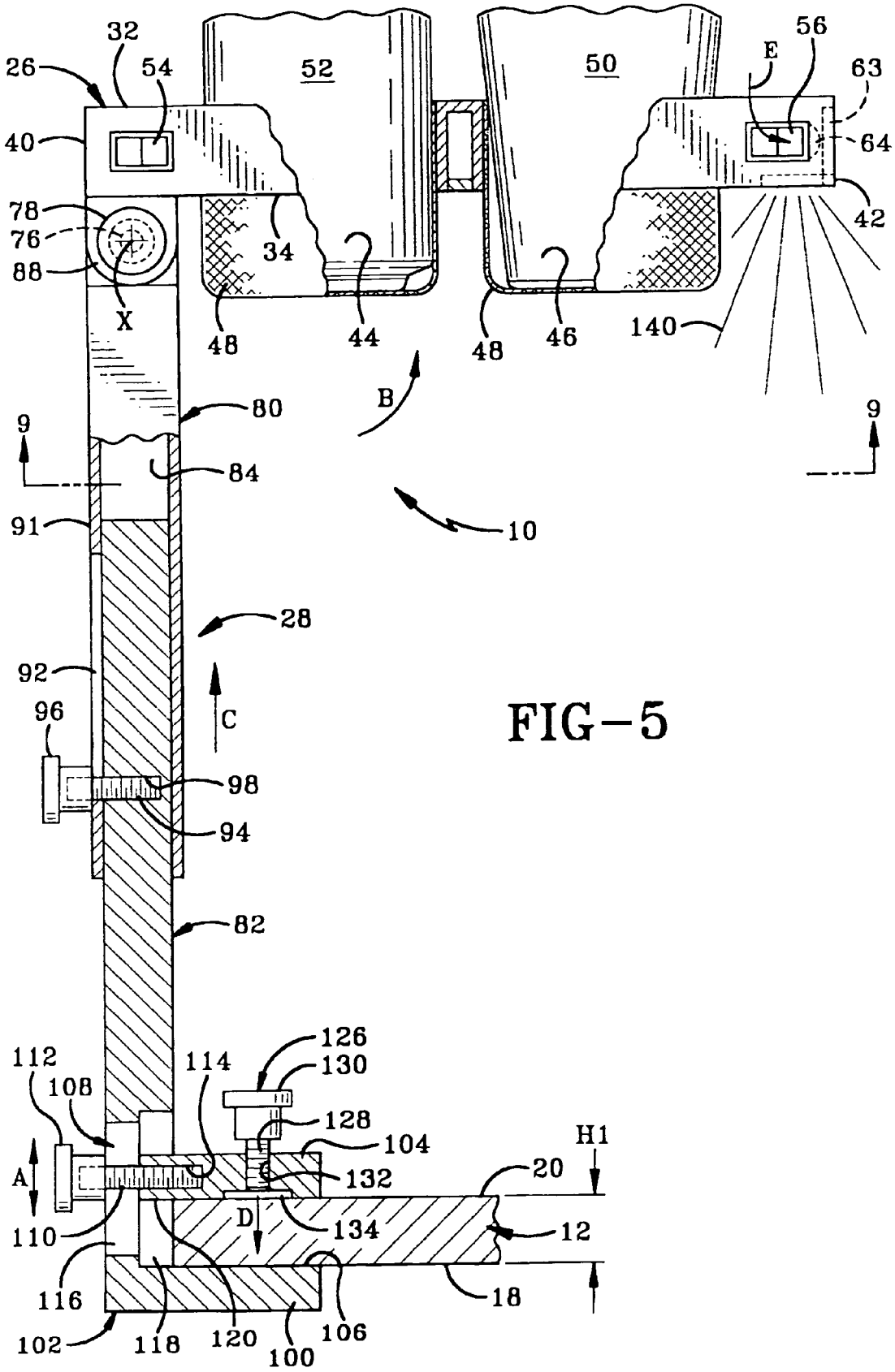
FIG. 5 is a front elevational view of the drink holder assembly with portions cut away and shown in section with drink containers seated thereon showing the reading light bulb illuminated.
Figure 6:
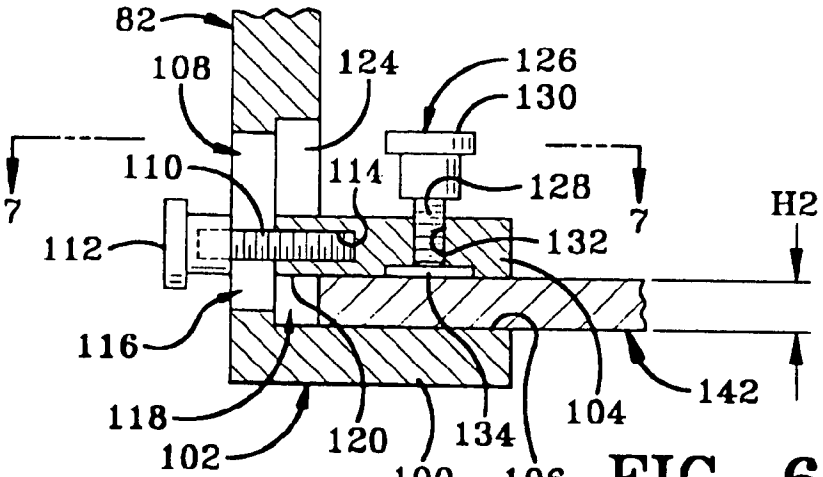
FIG. 6 is a sectional view of the clamping mechanism shown attached to an alternate tray table having a different thickness than that shown in FIG. 5.

The operation of assembly 10 is now described with reference to FIGS. 5 and 11-13. Assembly 10 is easily moved from the collapsed position shown in FIGS. 12 and 13 to the erected position shown in FIG. 5. More particularly, as shown in FIG. 5, drink holder 26 is rotated about pivot 76 as shown at arrow B to move second side 42 thereof away from support 28 so that holder 26 and support 28 are positioned substantially perpendicularly to one another. Handle 78 is manually rotated to tighten the retaining mechanism to secure drink holder 26 in the erected position. Upper arm segment 80 is then slid upwardly relative to lower arm segment 82 as indicated at arrow C to position holder 26 at a desired height. Handle 96 is rotated to secure segment 80 to segment 82 at a position associated with the desired height. Handle 112 is rotated to loosen the threaded rod 110 and allow second leg 104 to be adjusted as indicated at arrow A so that the lower surface of leg 104 abuts upper surface 20 of tray table 12 and so that first and second legs 102 and 104 define therebetween a height H1 which is substantially the same as the distance between lower and upper surfaces 18 and 20 of tray table 12. Handle 112 is then rotated to secure second leg 104 in place and handle 130 is rotated to move screw 126 downwardly as indicated at arrow D to clamp table tray 12 between disk 134 and leg 102 to securely mount assembly 10 on table tray 12. Drink containers 50 and 52 may then be disposed within receptacles 44 and 46. The frustoconical outer surface of container 50 engages the cylindrical inner surface 46 to provide a snug fit which prevents the tipping of container 50. Container 52 is supported by the pad 48 below receptacle 44 so that container 52 is sufficiently low enough that inner surface 44 prevents container 52 from tipping over. Switch 56 may be depressed as indicated at arrow E in order to turn light bulb 64 on so that light rays 140 are emitted downwardly through lens 62 in order to provide light on upper surface 20 of table tray 12 and various materials sitting thereon such as magazine 22 (FIG. 1). A light reflector (not shown) may be disposed adjacent light bulb 64 to focus the light rays downwardly. FIG. 6 shows an alternate tray table 142 having a lesser thickness than that of tray table 12 and shows the clamping mechanism adjusted to a height H2 between the legs 102 and 104 which is less than that of height H1, thus illustrating the ability to clamp onto various tables or trays having different thicknesses.

Figure 13:
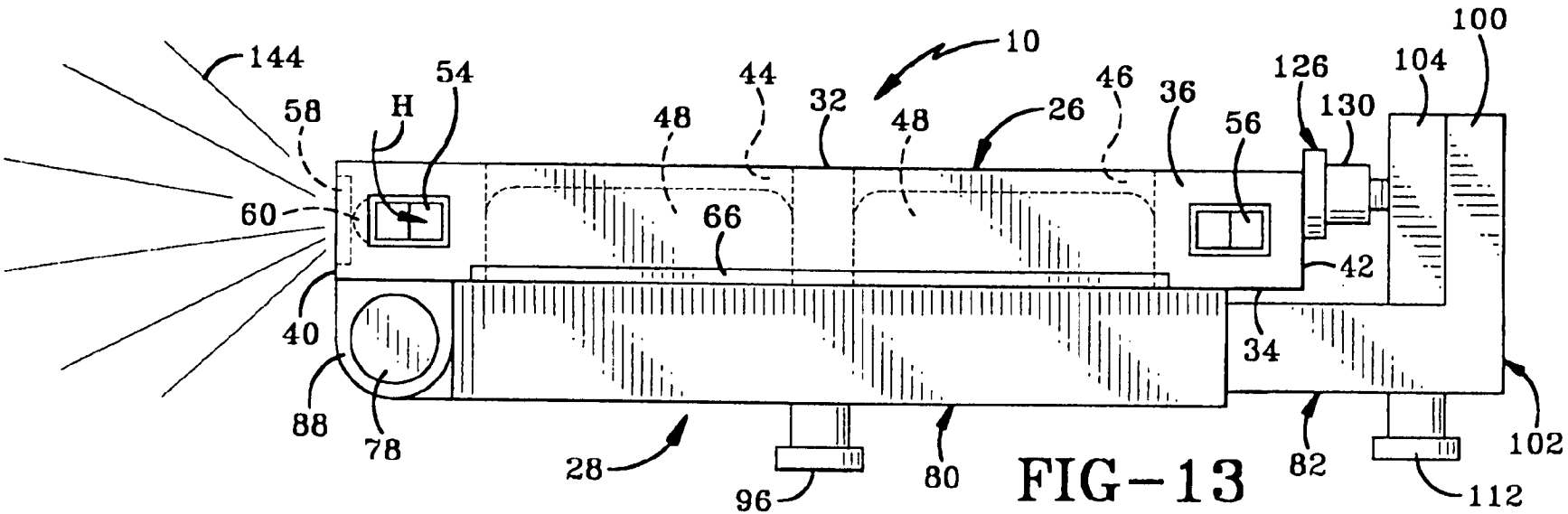
FIG. 13 is a front elevational view of the drink holder assembly in the fully collapsed position showing the flashlight bulb illuminated.
Figure 8:
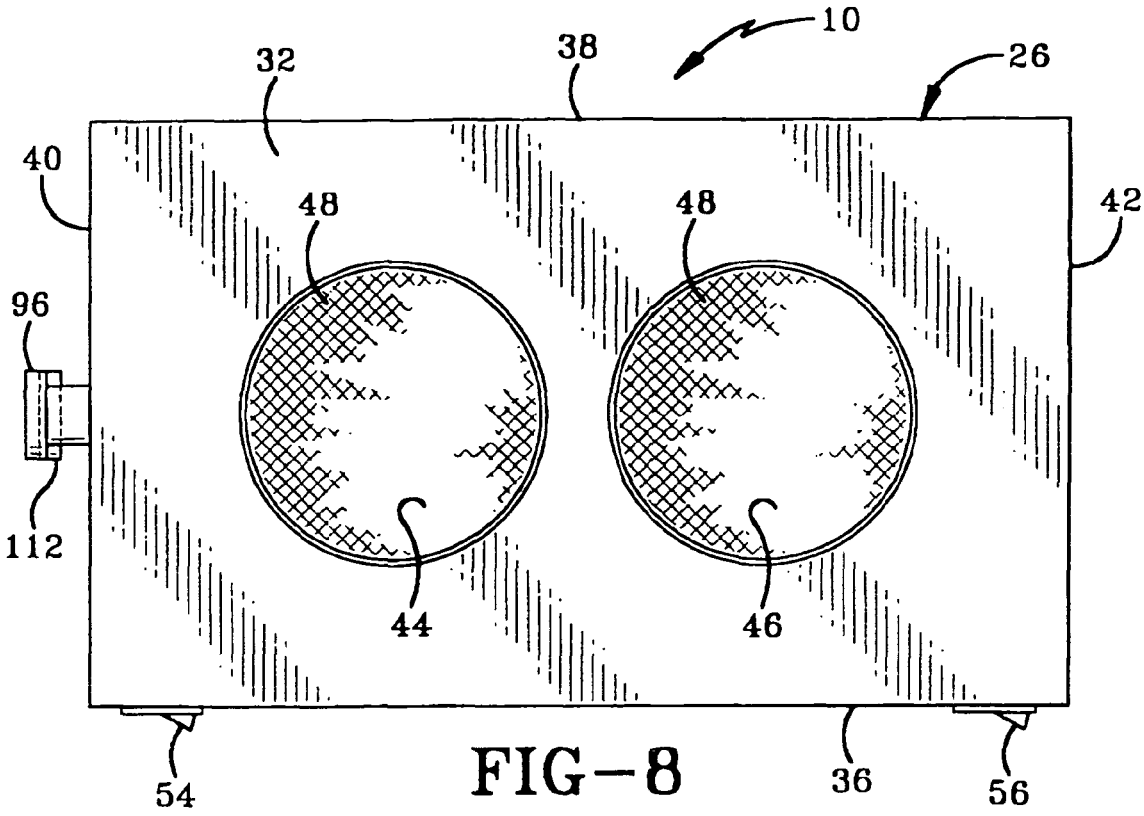
FIG. 8 is a top plan view of the drink holder assembly.

When the passenger is finished using assembly 10 in the erected position, the various securing mechanisms are loosened by manual manipulation of handles 78, 96, 112 and 130 in order to remove assembly 10 from table tray 12 and collapse assembly 10 to a compact portable collapsed position. More particularly, drink holder 26 is rotated about axis X as shown at arrow F in FIG. 11 to a partially collapsed position so that holder 26 is substantially parallel to support 28. Leg 104 is then moved toward leg 100 as indicated at arrow G in FIG. 12 so that legs 100 and 104 abut on another. Upper arm segment 80 is then slid relative to lower arm 82 as indicated at arrow H in FIG. 12 in order to fully collapse assembly 10. In the fully collapsed position, handle 130 of screw 126 abuts second side 42 of drink holder 26 and pads 48 are disposed respectively within receptacles 44 and 46, as shown in FIG. 13. With assembly 10 removed from table tray 12, it may now be used as a flashlight, which may be particularly useful during an emergency situation aboard an aircraft. More particularly, switch 54 is depressed as indicated at arrow H in FIG. 13 in order to turn light bulb 60 on to produce light rays 144 which are emitted through lens 58.

It will be appreciated by one skilled in the art that various changes may be made within the scope of the present invention. For instance, various mechanisms may be involved in allowing the drink holder assembly to move between the erected and collapsed positions and to hold the various parts in place in the erected position. While the exemplary embodiment describes a collapsible, portable drink holder assembly, various non-collapsible and/or non-portable configurations may also address the need for providing a drink holder behind a seat and above a table tray so that the table tray has greater utility without the interference of drink containers seated thereon. Thus, a non-portable drink holder may be connected directly and permanently to the back of an airline or other chair or be movable between stowed and operational positions. Other variations will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a drink holder adapted for supporting a drink container;

a support extending downwardly from the drink holder;

a tray mount connected to the support, spaced downwardly from the drink holder and adapted to mount the drink holder on a tray; and a first light carried by and disposed within the drink holder.

2. The apparatus of claim 1 wherein the drink holder defines a drink receptacle adapted to receive the drink container therein.

3. The apparatus of claim 1 wherein the drink holder comprises a substantially flat tray.

4. The apparatus of claim 1 wherein the drink holder is movable relative to the support between a first position in which the drink holder extends substantially perpendicularly to the support and a second position in which the drink holder and support are substantially parallel to one another.

5. The apparatus of claim 1 wherein the support has first and second opposed ends; the support is movable between a first position in which the first end is adjacent the drink holder and the second end is distal the drink holder and a second position in which the first and second ends are adjacent the drink holder.

6. The apparatus of claim 5 wherein the drink holder comprises a substantially flat tray which is substantially parallel to the support in the second position.

7. The apparatus of claim 1 further comprising an absorbent pad carried by the drink holder and adapted to be disposed below the drink container.

8. The apparatus of claim 1 wherein the support comprises a telescoping arm.

9. The apparatus of claim 1 wherein the support is pivotally connected to the drink holder.

10. The apparatus of claim 1 wherein the tray mount is a removable tray mount adapted to removably mount on the tray.

11. The apparatus of claim 1 wherein the tray mount comprises a clamp adapted to clamp onto the tray.

12. The apparatus of claim 1 wherein the first light is configured to emit light rays downwardly when the apparatus is in a mounting position adapted for mounting on the tray.

13. An apparatus comprising:

a drink holder adapted for supporting a drink container;

a support extending downwardly from the drink holder;

a tray mount connected to the support, spaced downwardly from the drink holder and adapted to mount the drink holder on a tray;

a first light;

wherein the first light is configured to emit light rays downwardly when the apparatus is in a mounting position adapted for mounting on the tray; the drink holder has a bottom defining an opening; and the first light is carried by the drink holder for emitting light rays downwardly through the opening.

14. The apparatus of claim 1 further comprising a second light carried by one of the drink holder and support.

15. The apparatus of claim 14 further comprising electrical circuitry providing independent operation of the first and second lights.

16. An apparatus comprising:

a drink holder adapted for supporting a drink container;

a support extending downwardly from the drink holder;

a tray mount connected to the support, spaced downwardly from the drink holder and adapted to mount the drink holder on a tray;

a first light carried by one of the drink holder and support; and a second light carried by one of the drink holder and support;

wherein the first light serves as a reading light and the second light serves as a flashlight.

17. The apparatus of claim 16 wherein the drink holder has a top, a bottom, a side extending therebetween, a first opening formed in the bottom and a second opening formed in the side; the first light is disposed within the drink holder above the first opening; and the second light is disposed within the drink holder adjacent the second opening.

18. An apparatus comprising:

a chair having a seat and a back extending upwardly therefrom;

a table tray mounted on the chair back and extending rearwardly therefrom;

a drink holder which is mounted on one of the table tray and chair back, spaced upwardly from the table tray and adapted for supporting a drink container; and a first light carried by and disposed within the drink holder.

19. The apparatus of claim 18 wherein the first light is configured to emit light rays downwardly toward the table tray.

20. The apparatus of claim 18 further comprising a second light carried by the drink holder.

21. The apparatus of claim 20 further comprising electrical circuitry providing independent operation of the first and second lights.

22. An apparatus comprising:

a chair having a seat and a back extending upwardly therefrom;

a table tray mounted on the chair back and extending rearwardly therefrom;

a drink holder which is mounted on one of the table tray and chair back, spaced upwardly from the table tray and adapted for supporting a drink container;

a first light carried by the drink holder; and a second light carried by the drink holder;

wherein the first light serves as a reading light and the second light serves as a flashlight.

23. The apparatus of claim 22 wherein the drink holder has a top, a bottom, a side extending therebetween, a first opening formed in the bottom and a second opening formed in the side; the first light is disposed within the drink holder above the first opening; and the second light is disposed within the drink holder adjacent the second opening.

24. The apparatus of claim 18 wherein the drink holder has a bottom defining an opening; and the first light is carried by the drink holder for emitting light rays downwardly through the opening.

25. The apparatus of claim 18 further comprising a battery compartment formed in the drink holder; and electrical circuitry within the drink holder which is in electrical communication with the first light and adapted to be in electrical communication with at least one battery when disposed in the battery compartment.

26. The apparatus of claim 18 wherein the drink holder is configured to fit within a purse and is removably mounted so that the drink holder serves as a flashlight when removed.

* * * * *